US009577353B2

(12) United States Patent
Shi

(10) Patent No.: US 9,577,353 B2
(45) Date of Patent: Feb. 21, 2017

(54) MAINS POWER WIRE CONNECTION ASSEMBLY AND CONNECTION METHOD

(71) Applicant: Shenzhen Top-Link Electronics Co., Ltd, Guangdong Province, Shenzhen (CN)

(72) Inventor: Jinbao Shi, Shenzhen (CN)

(73) Assignee: Shenzhen Top-Link Electronics Co. (CN)

( * ) Notice: Subject to any disclaimer, the term of this patent is extended or adjusted under 35 U.S.C. 154(b) by 49 days.

(21) Appl. No.: 14/404,830

(22) PCT Filed: Mar. 26, 2013

(86) PCT No.: PCT/CN2013/073179

§ 371 (c)(1),
(2) Date: Dec. 1, 2014

(87) PCT Pub. No.: WO2013/177971

PCT Pub. Date: Dec. 5, 2013

(65) Prior Publication Data

US 2015/0090492 A1 Apr. 2, 2015

(30) Foreign Application Priority Data

May 30, 2012 (CN) ..... 2012 1 0172527

(51) Int. Cl.

| | |
|---|---|
| ***H01R 4/00*** | (2006.01) |
| ***H01R 4/28*** | (2006.01) |
| ***H01R 4/24*** | (2006.01) |

(52) U.S. Cl.

CPC ..... *H01R 4/28* (2013.01); *H01R 4/2416* (2013.01); *H01R 4/2433* (2013.01); *H01R 4/2454* (2013.01)

(58) Field of Classification Search

CPC ..... H01R 11/11; H01R 4/023; H01R 4/20; H01R 13/519; H01R 13/59; H02G 15/043

USPC ..... 174/74 R, 84 R, 88 R, 84 C, 94 R

See application file for complete search history.

(56) References Cited

U.S. PATENT DOCUMENTS

| | | | | |
|---|---|---|---|---|
| 4,326,767 A * | 4/1982 | Silbernagel | ..... | H01R 4/2454 439/392 |
| 4,435,034 A * | 3/1984 | Aujla | ..... | H01R 4/2433 439/404 |
| 4,444,448 A * | 4/1984 | Silbernagel | ..... | H01R 4/2445 439/392 |
| 4,645,285 A * | 2/1987 | Cozzens | ..... | H01R 4/2433 439/395 |
| 5,120,246 A | 6/1992 | Knox | | |
| 5,205,761 A | 4/1993 | Nilsson | | |

(Continued)

FOREIGN PATENT DOCUMENTS

| | | | | |
|---|---|---|---|---|
| AU | 2011201455 | 3/2011 | | |
| AU | 2011201455 A1 * | 3/2011 | ..... | H01R 4/24 |

(Continued)

*Primary Examiner* — William H Mayo, III

(74) *Attorney, Agent, or Firm* — Ross Barnes LLP; Monty L. Ross; Roloin L. Barnes

(57) ABSTRACT

A mains power wire connection assembly (100) using a button to push a first wire and a second wire to move toward the direction of clamping slots, and the inner walls of the clamping slots puncture the first wire and second wires and clamp the same. The button and the insulation body are locked and fixed with respect to each other.

16 Claims, 14 Drawing Sheets

(56) References Cited

U.S. PATENT DOCUMENTS

| | | | | |
|---|---|---|---|---|
| 5,211,575 | A * | 5/1993 | Ustin | H01R 4/2454 439/417 |
| 2006/0240269 | A1 * | 10/2006 | Aoi | C08L 83/04 428/447 |

FOREIGN PATENT DOCUMENTS

| | | | | |
|---|---|---|---|---|
| CN | 92110982.2 | | 9/1992 | |
| CN | 200780030144.X | | 6/2007 | |
| CN | 201120306752.2 | | 8/2011 | |
| CN | 201110378587.6 | | 11/2011 | |
| CN | 102364753 | A * | 2/2012 | H01R 13/02 |
| CN | 201210172527.3 | | 5/2012 | |
| EP | 0684662 | A1 * | 5/2011 | H01R 9/07 |

* cited by examiner

MAINS POWER WIRE CONNECTION ASSEMBLY AND CONNECTION METHOD

FIELD OF THE INVENTION

The present invention relates to a connection assembly and a connection method, and in particular, to a mains power wire connection assembly and a connection method that are capable of electrically and mechanically connecting mains power wires conveniently, quickly, and reliably.

BACKGROUND OF THE INVENTION

With continuous development of the economy and continuous advancement of the science and technology, abundant electrical products are available in people's lives. The wide use of electrical products increases the demand on electricity resources, which creates good conditions for development of the mains power wire industry, and therefore improves popularity of mains power wires.

It is commonly known that a mains power wire is a cable whose transmission voltage ranges from 110 to 380 voltages. When a mains power wire is installed outdoors, because mains power wires on the market are generally available in rolls and a length of each roll of wires is relatively fixed, outdoor mains power wires need to be joined and fixed for long-distance electrical power transmission. Likewise, when electrical power from a mains power wire that supplies electrical power outdoors needs to be transferred indoors for people to use an electrical product, the outdoor mains power wire and an indoor mains power wire need to be joined and fixed. Furthermore, during installation of various indoor electrical products, mains power wires are also frequently joined and fixed. At present, a common method for joining and fixing mains power wires is performed as follows: first, an operator removes, by using a cutting tool, insulation layers of mains power wires that are to be joined, so as to expose conductors; next, the operator twists the conductors that are to be joined, so as to implement an electrical connection between the mains power wires; and finally, the operator wraps a twist joint of the conductors with an insulating tape for sealing, so as to prevent people from being electrically shocked accidentally and to achieve a certain fixing effect.

However, the above process of joining and connecting the mains power wires involves operations of removing the insulation layers of the mains power wires, twisting the conductors of the mains power wires, and wrapping the twist joint of the conductors with the insulating tape. On one hand, this makes it very complex to join and connect the mains power wires, increases a load of the operator, and consequently reduces operational efficiency. On the other hand, the conductor is likely to be damaged when the operator removes the insulation layer, which results in waste of the mains power wires. Furthermore, when the conductors of the mains power wires are twisted together, tensile performance of the twist joint of the conductors is reduced because of twisting and deformation of the conductors, resulting in that the electrical connection between the mains power wires is not reliable. The twist joint of the mains power wires are fixed by wrapping the insulating tape; this mechanical fixing is not firm and is likely to break accidentally.

Therefore, a mains power wire connection assembly, a connector, and a connection method are urgently required to address the foregoing defects.

SUMMARY OF THE INVENTION

Technical Problem

One objective of the present invention is to provide a mains power wire connection assembly, where the mains power wire connection assembly is capable of electrically connecting mains power wires without first removing insulation layers of the mains power wires, which reduces a load of an operator and enables an electrical and mechanical connection between the mains power wires to be convenient, quick, and reliable on one hand, and avoids resource waste on the other hand.

Another objective of the present invention is to provide a mains power wire connection method, which is capable of electrically and mechanically connecting mains power wires conveniently, quickly, and reliably, and avoiding resource waste.

Still another objective of the present invention is to provide a connector, where the connector is capable of electrically connecting mains power wires without first removing insulation layers of the mains power wires, which reduces a load of an operator and enables an electrical and mechanical connection between the mains power wires to be convenient, quick, and reliable on one hand, and avoids resource waste on the other hand.

Technical Solution

To achieve the foregoing objective, the present invention provides a mains power wire connection assembly, which includes: a first wire, configured to transfer mains power; a second wire, configured to transfer mains power; and a connector, configured to connect the first wire to the second wire, where the connector includes an insulation body, a button, and a conductive connection terminal; the insulation body is provided with cable passages separately at two ends thereof; the insulation body is further provided with a containing cavity which is located between and in communication with the two cable passages; the connection terminal is arranged in the containing cavity and has a base; the base is mounted at the bottom end of the insulation body, and both ends of the base respectively bend and extend to form puncturing clamping ends corresponding to the cable passages; the puncturing clamping ends are provided with clamping slots corresponding to the cable passages and extending toward the base; the button is slidably mounted at the top end of the insulation body and has a push portion extending into the containing cavity; the first wire is led into the cable passage and the puncturing clamping end at one end of the connector, and the second wire is led into the cable passage and the puncturing clamping end at the other end of the connector; the first and second wires are pushed by the push portion of the button to move toward the clamping slots, and are punctured and clamped by inner walls of the clamping slots; and the button and the insulation body are locked and fixed with respect to each other.

Preferably, the puncturing clamping ends are further provided with through holes corresponding to the cable passages, the through holes are located above the clamping slots and are in communication with the clamping slots respectively, and the wires are led through the through holes into the puncturing clamping ends, so that the first and second wires are inserted into the connector very conveniently; moreover, a problem that the first and second wires displace because of no restriction when the inner walls of the first and second clamping slots puncture the first and second wires and a problem of very bad puncturing effect caused by the displacement may be solved, so as to further improve a puncturing and clamping effect of the mains power wire connection assembly according to the present invention, and further ensure reliability of an electrical and mechanical connection between the first and second wires.

Preferably, sharp cutting edge portions are formed on portions of the inner walls, which are adjacent to the through holes, of the clamping slots, and joints between the clamping slots and the through holes are of an arc shape, so that the cutting edge portions puncture insulation layers of the first and second wires more easily, and conductors of the punctured first and second wires may be clamped in the clamping slots of the puncturing clamping ends more reliably, so that the electrical connection that is between the first and second wires and provided by the mains power wire connection assembly according to the present invention is more reliable.

Preferably, the connection terminals are provided in pairs, one connection terminal is superimposed with and located within the other connection terminal, and a distance between clamping slots of one of the two connection terminals is different from that of the other of the two connection terminals, so that the mains power wire connection assembly according to the present invention may electrically connect first and second wires of different wire diameters, so as to expand a service range of the mains power wire connection assembly according to the present invention.

Preferably, an inner wall of the containing cavity is provided with receiving and locating slots configured to receive and fix the puncturing clamping ends of the connection terminal, so that the connection terminal may be conveniently and reliably fixed in the insulation body.

Preferably, the button is provided with elastic locking blocks on two sides thereof, the insulation body is correspondingly provided with locking slots matching with the locking blocks, and the locking blocks are locked in the locking slots, so that the locking blocks and the locking slots are matched with each other to enable the button and the insulation body to be locked with respect to each other easily and reliably, which may prevent as much as possible the clamped first and second wires from getting loose, so that the electrical and mechanical connection that is between the first and second wires and provided by the mains power wire connection assembly according to the present invention is more reliable. Specifically, the locking block includes a first locking block and a second locking block located sequentially along a pushing direction, and during slide movement of the button into the insulation body, the locking slots lock the second and first locking blocks sequentially, so as to effectively prevent, by using the second locking block, the button from leaving the insulation body before the button pushes the first and second wires to be punctured, which facilitates operations to be performed by an operator.

Preferably, the button is provided with slide slots on two sides thereof along a pushing direction, the insulation body is correspondingly provided with slide guides matching with the slide slots, and the button is further provided with matching slots matching with the puncturing clamping ends, where the puncturing clamping ends may slidably extend into the matching slots. The slide slots and the slide guides are matched with each other to accurately guide movement of the button, so that the button may drive more reliably the first and second wires to be punctuated and clamped in the puncturing clamping ends. The matching slots are used so that the puncturing clamping ends may extend in the button, and may further guide the button, so that the button may drive more reliably the first and second wires to be punctuated and clamped in the puncturing clamping ends.

To achieve the foregoing objective, the present invention provides another mains power wire connection assembly, which includes: a first wire, configured to transfer mains power; a second wire, configured to transfer mains power; and a connector, configured to connect the first wire to the second wire, where the connector includes an insulation body, a button, and a conductive connection terminal; the insulation body is provided with a first cable passage and a second cable passage; the insulation body is further provided with a containing cavity which is in communication with the first and second cable passages; the connection terminal is arranged in the containing cavity and has a base, a first puncturing clamping end, and a second puncturing clamping end; the base is mounted at the bottom end of the insulation body; the first puncturing clamping end is provided with a first clamping slot corresponding to the first cable passage and extending toward the base, and the second puncturing clamping end is provided with a second clamping slot corresponding to the second cable passage and extending toward the base; the button is movably mounted at the top end of the insulation body and has a push portion extending into the containing cavity; the first wire is led into the first cable passage and the first puncturing clamping end, and the second wire is led into the second cable passage and the second puncturing clamping end; the first and second wires are pushed by the push portion of the button to move toward the first and second clamping slots, and are punctured and clamped by inner walls of the first and second clamping slots; and the button and the insulation body are locked and fixed with respect to each other.

Preferably, the first puncturing clamping end is further provided with a first through hole corresponding to the first cable passage, the first through hole is located above the first clamping slot and is in communication with the first clamping slot, and the first wire is led through the first through hole into the first puncturing clamping end; and the second puncturing clamping end is further provided with a second through hole corresponding to the second cable passage, the second through hole is located above the second clamping slot and is in communication with the second clamping slot, and the second wire is led through the second through hole into the second puncturing clamping end, so that the first and second wires are inserted into the connector very conveniently; moreover, a problem that the first and second wires displace because of no restriction when the inner walls of the first clamping slot and second clamping slot puncture the first and second wires and a problem of very bad puncturing effect caused by the displacement may be solved, so as to further improve a puncturing and clamping effect of the mains power wire connection assembly according to the present invention, and further ensure reliability of an electrical and mechanical connection between the first and second wires.

Preferably, a sharp first cutting edge portion is formed at a portion of the inner wall, which is adjacent to the first through hole, of the first clamping slot, and a joint between the first clamping slot and the first through hole is of an arc shape; and a sharp second cutting edge portion is formed at a portion of the inner wall, which is adjacent to the second through hole, of the second clamping slot, and a joint between the second clamping slot and the second through hole is of an are shape, so that the first cutting edge portion punctuates an insulation layer of the first wire more easily, and a conductor of the punctuated first wire may be clamped in the first clamping slot of the first puncturing clamping end more reliably, and likewise, the second cutting edge portion punctuates an insulation layer of the second wire more easily, and a conductor of the punctuated second wire may be clamped in the second clamping slot of the second puncturing clamping end more reliably, so that the electrical connection that is between the first and second wires and provided by the mains power wire connection assembly according to the present invention is more reliable.

Preferably, the button is provided with elastic locking blocks on two sides thereof, the insulation body is correspondingly provided with locking slots matching with the locking blocks, and the locking blocks are locked in the locking slots, so that the locking blocks and the locking slots are matched with each other to enable the button and the insulation body to be locked easily and reliably, which may prevent as much as possible the clamped first and second wires from getting loose, so that the electrical and mechanical connection that is between the first and second wires and provided by the mains power wire connection assembly according to the present invention is more reliable.

A mains power wire connection method according to the present invention includes the following steps:

(1) providing a connector, where the connector includes an insulation body, a button, and a conductive connection terminal; the insulation body is provided with a first cable passage at one end thereof, and the insulation body is provided with a second cable passage at the other end thereof; the insulation body is further provided with a containing cavity which is located between and in communication with the first and second cable passages; the connection terminal is arranged in the containing cavity and has a base; the base is mounted at the bottom end of the insulation body; one end of the base bends and extends to form a first puncturing clamping end corresponding to the first cable passage, and the first puncturing clamping end is provided with a first clamping slot corresponding to the first cable passage and extending toward the base; the other end of the base bends and extends to form a second puncturing clamping end corresponding to the second cable passage, and the second puncturing clamping end is provided with a second clamping slot corresponding to the second cable passage and extending toward the base; and the button is slidably mounted at the top end of the insulation body and has a push portion extending into the containing cavity;

(2) providing a first wire for transferring mains power, and inserting the first wire into the first cable passage and the first puncturing clamping end;

(3) providing a second wire for transferring mains power, and inserting the second wire into the second cable passage and the second puncturing clamping end; and (4) pressing the button until the button is locked and fixed with respect to the insulation body, where during the pressing, the first and second wires are pushed by the push portion of the button to move respectively toward the first and second clamping slots, and are punctuated and clamped by inner walls of the first and second clamping slots respectively during movement.

Preferably, the first puncturing clamping end is further provided with a first through hole corresponding to the first cable passage, the first through hole is located above the first clamping slot and is in communication with the first clamping slot, and the first wire is led through the first through hole into the first puncturing clamping end; and the second puncturing clamping end is further provided with a second through hole corresponding to the second cable passage, the second through hole is located above the second clamping slot and is in communication with the second clamping slot, and the second wire is led through the second through hole into the second puncturing clamping end, so that the first and second wires are inserted into the connector very conveniently; moreover, a problem that the first and second wires displace because of no restriction when the inner walls of the first and second clamping slots puncture the first and second wires and a problem of very bad puncturing effect caused by the displacement may be solved, so as to further improve a puncturing and clamping effect of the mains power wire connection assembly according to the present invention, and further ensure reliability of the electrical and mechanical connection between the first and second wires.

Another mains power wire connection method according to the present invention includes the following steps:

(1) providing a connector, where the connector includes an insulation body, a button, and a conductive connection terminal; the insulation body is provided with a first cable passage and a second cable passage, the insulation body is further provided with a containing cavity which is in communication with the first and second cable passages; the connection terminal is arranged in the containing cavity and has a base, a first puncturing clamping end, and a second puncturing clamping end; the base is mounted at the bottom end of the insulation body; the first puncturing clamping end is provided with a first clamping slot corresponding to the first cable passage and extending toward the base; the second puncturing clamping end is provided with a second clamping slot corresponding to the second cable passage and extending toward the base; and the button is movably mounted at the top end of the insulation body and has a push portion extending into the containing cavity;

(2) providing a first wire for transferring mains power, and inserting the first wire into the first cable passage and the first puncturing clamping end;

(3) providing a second wire for transferring mains power, and inserting the second wire into the second cable passage and the second puncturing clamping end; and (4) pressing the button until the button is locked and fixed with respect to the insulation body, wherein during the pressing, the first and second wires are pushed by the push portion of the button to move toward the corresponding first and second clamping slots, and punctuated and clamped by inner walls of the first and second clamping slots during movement.

A connector according to the present invention is configured to connect a first wire and a second wire that are configured to transfer mains power, where the connector includes an insulation body, a button, and a conductive connection terminal; the insulation body is provided with a first cable passage and a second cable passage on one side thereof; the insulation body is further provided with a containing cavity which is in communication with the first and second cable passages; the connection terminal is arranged in the containing cavity and has a base, a first puncturing clamping end, and a second puncturing clamping end; the base is mounted at the bottom end of the insulation body; the first puncturing clamping end is provided with a first clamping slot corresponding to the first cable passage and extending toward the base, and the second puncturing clamping end is provided with a second clamping slot corresponding to the second cable passage and extending toward the base; the button is movably mounted at the top end of the insulation body and has a push portion extending into the containing cavity; the first wire is led into the first cable passage and the first puncturing clamping end, and the second wire is led into the second cable passage and the second puncturing clamping end; the first and second wires are pushed by the push portion of the button to move toward the first and second clamping slots, and are punctured and clamped by inner walls of the first and second clamping slots; and the button and the insulation body are locked and fixed with respect to each other.

Preferably, the first puncturing clamping end is further provided with a first through hole corresponding to the first cable passage, the first through hole is located above the first clamping slot and is in communication with the first clamping slot, and the first wire is led through the first through hole into the first puncturing clamping end; and the second puncturing clamping end is further provided with a second through hole corresponding to the second cable passage, the second through hole is located above the second clamping slot and is in communication with the second clamping slot, and the second wire is led through the second through hole into the second puncturing clamping end, so that the first and second wires are inserted into the connector very conveniently; moreover, a problem that the first and second wires displace because of no restriction when the inner walls of the first clamping slot and second clamping slot puncture the first and second wires and a problem of very bad puncturing effect caused by the displacement may be solved, so as to further improve a puncturing and clamping effect of the connector according to the present invention, and further ensure reliability of the electrical and mechanical connection between the first and second wires.

Preferably, a sharp first cutting edge portion is formed at a portion of the inner wall, which is adjacent to the first through hole, of the first clamping slot, and a joint between the first clamping slot and the first through hole is of an arc shape; and a sharp second cutting edge portion is formed at a portion of the inner walls, which is adjacent to the second through hole, of the second clamping slot, and a joint between the second clamping slot and the second through hole is of an arc shape, so that the first cutting edge portion punctuates an insulation layer of the first wire more easily, and a conductor of the punctuated first wire may be clamped in the first clamping slot of the first puncturing clamping end more reliably, and likewise, the second cutting edge portion punctuates an insulation layer of the second wire more easily, and a conductor of the punctuated second wire may be clamped in the second clamping slot of the second puncturing clamping end more reliably, so that the electrical connection that is between the first and second wires and provided by the connector according to the present invention is more reliable.

Preferably, the button is provided with elastic locking blocks on two sides thereof, the insulation body is correspondingly provided with locking slots matching with the locking blocks, and the locking blocks are locked in the locking slots, so that the locking blocks and the locking slots are matched with each other to enable the button and the insulation body to be locked easily and reliably, which may prevent as much as possible the clamped first and second wires from getting loose, so that the electrical and mechanical connection that is between the first and second wires and provided by the connector according to the present invention is more reliable.

BENEFITS OF THE INVENTION

Compared with the prior arts, an insulation body is provided with cable passages separately at two ends thereof; the insulation body is further provided with a containing cavity which is located between and in communication with the two cable passages; a connection terminal is arranged in the containing cavity and has a base; the base is mounted at the bottom end of the insulation body, and both ends of the base respectively bend and extend to form puncturing clamping ends corresponding to the cable passages; the puncturing clamping ends are provided with clamping slots corresponding to the cable passages and extending toward the base; a button is slidably mounted at the top end of the insulation body and has a push portion extending into the containing cavity; when a first wire is led into the cable passage and the puncturing clamping end at one end of the connector and a second wire is led into the cable passage and the puncturing clamping end at the other end of the connector, an operator presses the button, so that the first and second wires are pushed by the push portion of the button to move toward the clamping slots, and punctuated and clamped by inner walls of the clamping slots during movement, so that the first and second wires may be electrically clamped onto the connector without first removing insulation layers, so that an electrical and mechanical connection that is between mains power wires and provided by the mains power wire connection assembly according to the present invention is achieved conveniently and quickly, thereby reducing a load of the operator and avoiding resource waste; moreover, when the first and second wires are clamped by the inner walls of the clamping slots, the first and second wires are also under a fixing force provided by the button and the insulation body that are locked and fixed with respect to each other, so as to effectively prevent the first and second wires that are electrically and mechanically connected from getting loose, and avoid a problem of decreased tensile performance caused when conductors of the mains power wires are conventionally connected by twisting, so that the electrical and mechanical connection that is between the mains power wires and provided by the mains power wire connection assembly according to the present invention is more reliable.

PREFERRED EMBODIMENTS OF THE INVENTION

The following further describes the technical content and structural features of the present invention in detail with reference to embodiments and accompanying drawings.

Figure 1:
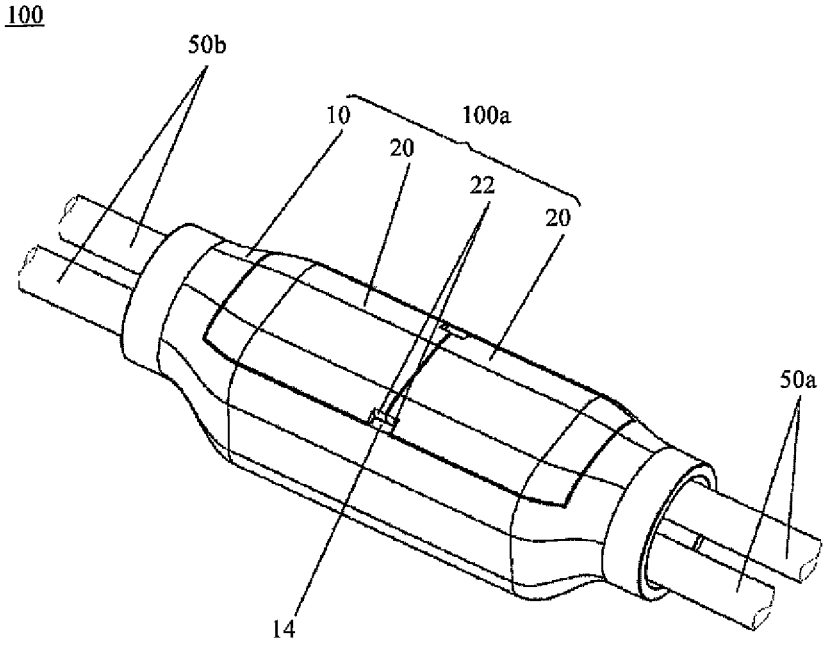
FIG. 1 is a schematic structural diagram of a first embodiment of a mains power wire connection assembly according to the present invention.
Figure 2:
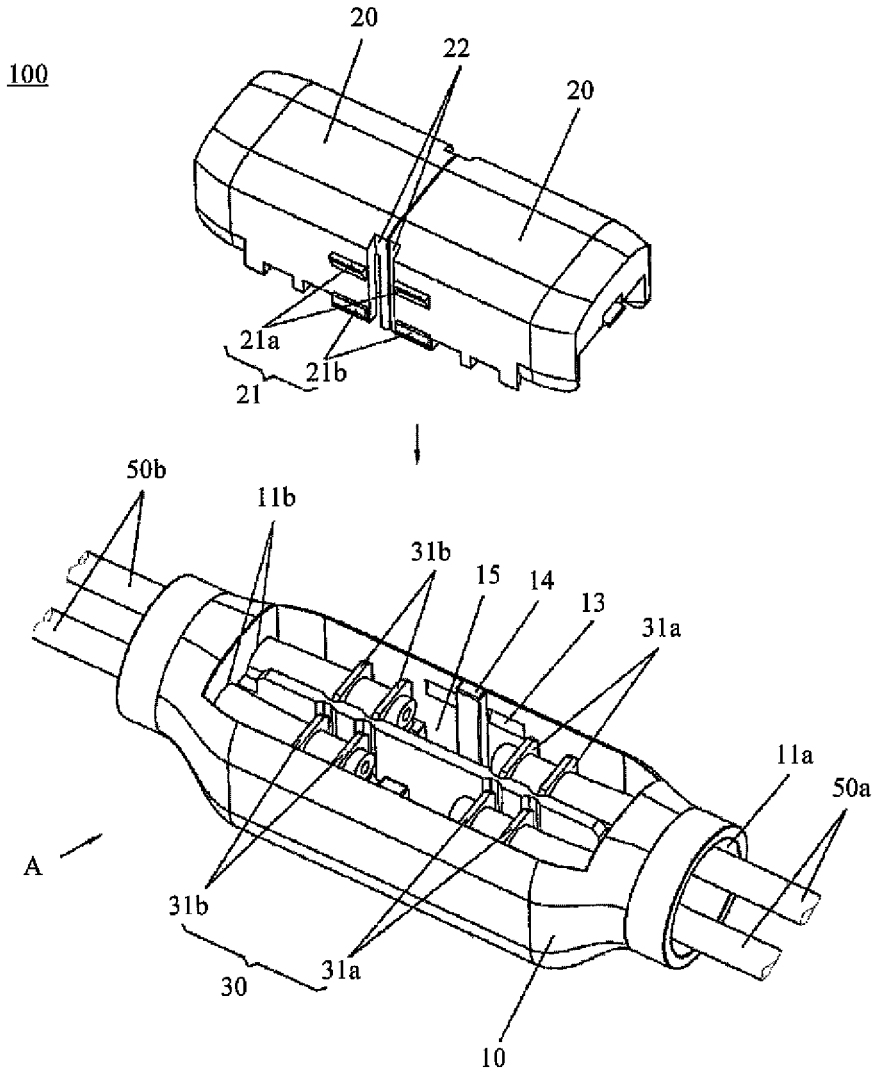
FIG. 2 is an exploded view of FIG. 1.
Figure 3:
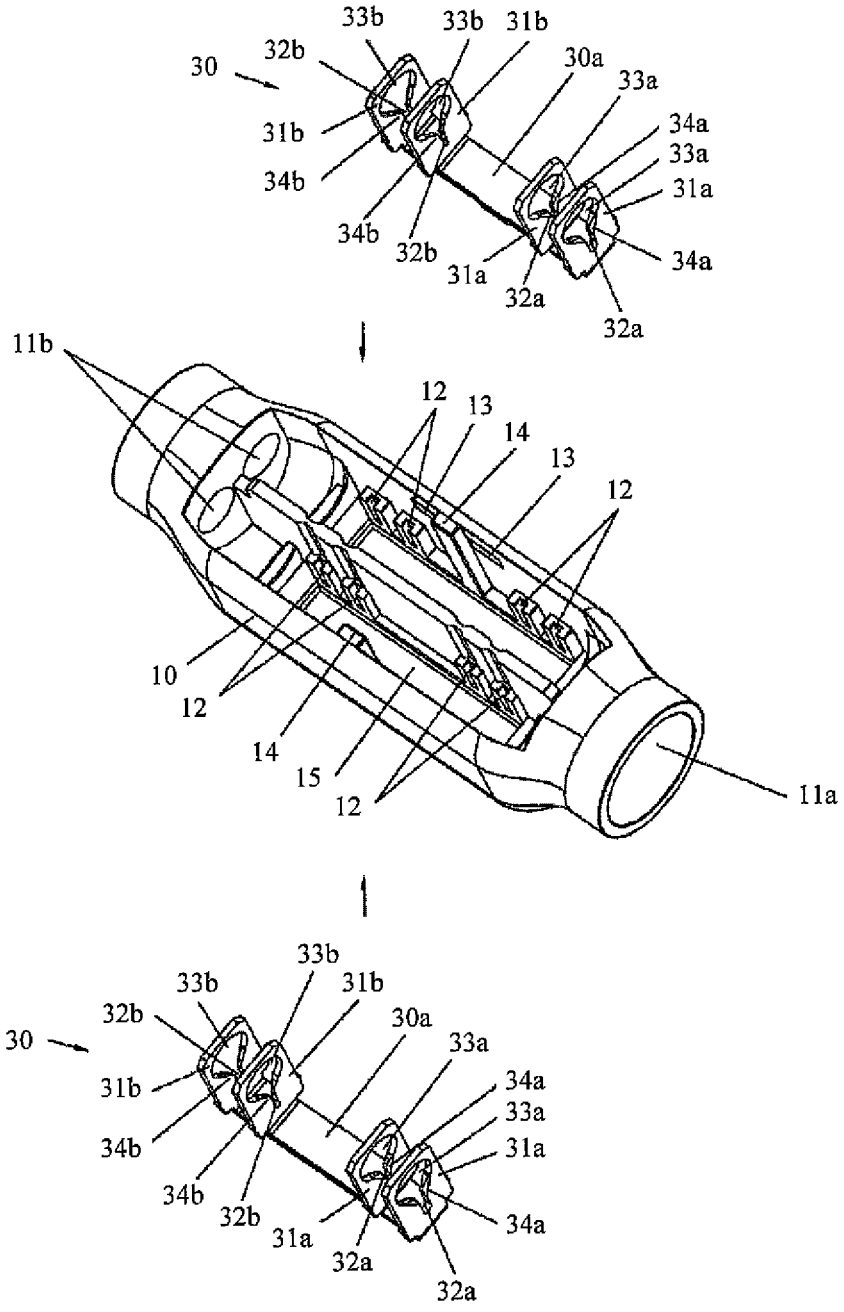
FIG. 3 is an exploded view of the portion A in FIG. 2 after first and second wires are removed.
Figure 4:
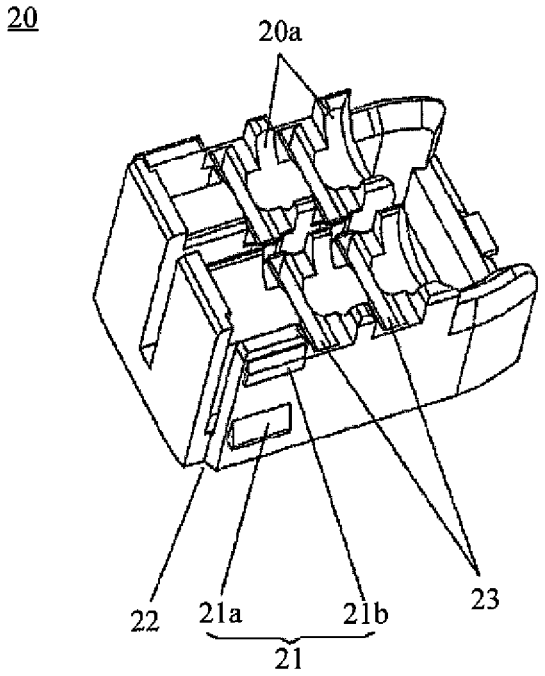
FIG. 4 is a schematic structural diagram of a button of a mains power wire connection assembly shown in FIG. 1.

Referring to FIG. 1, FIG. 1 shows a first embodiment of a mains power wire connection assembly 100 according to the present invention. With reference to FIG. 2 to FIG. 4, the mains power wire connection assembly 100 according to the present invention is applicable to a scenario of mains power transmission, where the mains power wire connection assembly 100 according to the present invention includes a first wire 50*a* configured to transfer mains power, a second wire 50*b* configured to transfer mains power, and a connector 100*a* configured to connect the first wire 50*a* to the second wire 50*b*. The first wire 50*a* and the second wire 50*b* are collectively referred to as the mains power wires. The connector 100*a* includes an insulation body 10, a button 20, and a conductive connection terminal 30. The insulation body 10 is provided with cable passages separately at two ends thereof. For ease of description, the cable passages that are provided separately at the two ends of the insulation body 10 are respectively referred to as a first cable passage 11*a* and a second cable passage 11*b*. The insulation body 10 is further provided with a containing cavity 15 which is located between and in communication with the first and second cable passages 11*a* and 11*b*.

The connection terminal 30 is arranged in the containing cavity 15 and has a base 30*a*; the base 30*a* is mounted at the bottom end of the insulation body 10, and both ends of the base 30*a* respectively bend and extend to form puncturing clamping ends corresponding to the cable passages. Specifically, the right end of the base 30*a* bends and extends to form a first puncturing clamping end 31*a* corresponding to the first cable passage 11*a*, the left end of the base 30*a* bends and extends to form a second puncturing clamping end 31*b* corresponding to the second cable passage 11*b*, the first puncturing clamping end 31*a* is provided with a first clamping slot 32*a* corresponding to the first cable passage 11*a* and extending toward the base 30*a*, and the second puncturing clamping end 31*b* is provided with a second clamping slot 32*b* corresponding to the second cable passage 11*b* and extending toward the base 30*a*. Specifically, in this embodiment, to allow the connection terminal 30 to be conveniently and reliably fixed in the insulation body 10, an inner wall of the containing cavity 15 is provided with receiving and locating slots 12 configured to receive and fix the first puncturing clamping end 31*a* and the second puncturing clamping end 31*b* of the connection terminal 30.

Moreover, the button 20 is movably mounted at the top end of the insulation body 10. Specifically, in this embodiment, the button 20 is slidably mounted at the top end of the insulation body 10. A manner for implementing that the button 20 is slidably mounted at the top end of the insulation body 10 is that: the button 20 is provided with slide slots 22 on two sides thereof along a push direction (a direction indicated by the arrow B in FIG. 6*c*), the insulation body 10 is correspondingly provided with slide guides 14 matching with the slide slots 22. In this embodiment, the slide guide 14 protrudes from the inner wall of the containing cavity 15 toward the containing cavity 15. A slidable connection between the button 20 and the insulation body 10 is implemented by the matched slide guides 14 and slide slots 22; moreover, accurate guidance may be provided for the movement of the button 20, so that the button 20 may drive more reliably the first and second wires 50*a* and 50*b* to be punctured and clamped by the corresponding first and second puncturing clamping ends 31*a* and 31*b*. Furthermore, the button 20 has a push portion 20*a* extending into the containing cavity 15. When the first wire 50*a* is led into the first cable passage 11*a* and the first puncturing clamping end 31*a* at the right end of the connector 100*a*, and the second wire 50*b* is led into the second cable passage 11*b* and the second puncturing clamping end 31*b* at the left end of the connector 100*a*, the first and second wires 50*a* and 50*b* are respectively moved toward the first and second clamping slots 32*a* and 32*b* under pushing of the push portion 20*a* of the button 20 (that is, the first wire 50*a* is moved toward the first clamping slot 32*a* under pushing of the push portion 20*a* of the button 20, and the second wire 50*b* is moved toward the second clamping slot 32*b* under pushing of the push portion 20*a* of the button 20). Inner walls of the first and second clamping slots 32*a* and 32*b* respectively puncture and clamp the first and second wires 50*a* and 50*b* (that is, the inner walls of the first clamping slot 32*a* puncture and clamp the first wire 50*a*, and the inner walls of the second clamping slot 32*b* puncture and clamp the second wire 50*b*). The button 20 and the insulation body 10 are locked and fixed with respect to each other in a state shown in FIG. 1, FIG. 6*d*, or FIG. 8*b*. More specific description is as follows:

Referring to FIG. 3, the puncturing clamping ends mentioned above are further provided with through holes corresponding to the cable passages, the through holes are located above the clamping slots and are in communication with the clamping slots, and the through holes lead the wires into the puncturing clamping ends. Specifically, the first puncturing clamping end 31*a* is further provided with a first through hole 33*a* corresponding to the first cable passage 11*a*, and the second puncturing clamping end 31*b* is further provided with a second through hole 33*b* corresponding to the second cable passage 11*b*; the first through hole 33*a* is located above the first clamping slot 32*a* and is in communication with the first clamping slot 32; and the second through hole 33*b* is located above the second clamping slot 32*b* and is in communication with the second clamping slot 32*b*; and the first through hole 33*a* leads the first wire 50*a* into the first puncturing clamping end 31*a*, and the second through hole 33*b* leads the second wire 50*b* into the second puncturing clamping end 31*b*, so that the first and second wires 50*a* and 50*b* are inserted into the connector 100*a* very conveniently; moreover, a problem that the first and second wires 50*a* and 50*b* displace because of no restriction when the inner walls of the first and second clamping slots 32*a* and

32*b* puncture the first and second wires 50*a* and 50*b* and a problem of very bad puncturing effect caused by the displacement may be solved, so as to further improve a puncturing and clamping effect of the mains power wire connection assembly 100 according to the present invention, and further ensure reliability of the electrical and mechanical connection between the first and second wires 50*a* and 50*b*.

Next, referring to FIG. 4, the button 20 is provided with a matching slot 23 matching with the first and second puncturing clamping ends 31*a* and 31*b*, where the first and second puncturing clamping ends 31*a* and 31*b* may slidably extend into the matching slot 23, so that the first and second puncturing clamping ends 31*a* and 31*b* may further guide the button 20 while extending in the button 20. Therefore, the button 20 may reliably drive the first and second wires 50*a* and 50*b* to be punctured and clamped by the corresponding first and second puncturing clamping ends 31*a* and 31*b*. Moreover, a manner in which the button 20 and insulation body 10 are locked and fixed with respect to each other is that: the button 20 is provided with elastic locking blocks 21 on two sides thereof, the insulation body 10 is correspondingly provided with locking slots 13 matching with the locking blocks 21, and the locking blocks 21 are locked in the respective locking slots 13, so that the button 20 and the insulation body 10 may be locked easily and reliably, which may prevent as much as possible the clamped first and second wires 50*a* and 50*b* from getting loose, so that the electrical and mechanical connection that is between the first and second wires 50*a* and 50*b* and provided by the mains power wire connection assembly 100 according to the present invention is more reliable. To enable the button 20 and the insulation body 10 to be fixed more reliably, the locking block 21 includes a first locking block 21*a* and a second locking block 21*b* located sequentially along a pushing direction. Specifically, the first locking block 21*a* and the second locking block 21*b* are on the same line along a pressing direction; in a process in which the button 20 slides into the insulation body 10, the locking slots 13 lock the second and first locking blocks 21*b* and 21*a* one by one, so as to effectively prevent, by using the second locking block 21*b*, the button 20 from leaving the insulation body 10 before the button 20 pushes the first and second wires 50*a* and 50*b* to be punctured, which facilitates operations to be performed by an operator. In addition, the buttons 20 are provided in pairs and aligned in a line, which enables the operator to push corresponding first and second wires 50*a* and 50*b* by using respective buttons 20, so that the first and second wires 50*a* and 50*b* are punctured more easily, which further facilitates the operations to be performed by the operator.

Referring to FIG. 3, a sharp first cutting edge portion 34*a* is formed at a portion of the inner wall, which is adjacent to the first through hole 33*a*, of the first clamping slot 32*a* mentioned above, a sharp second cutting edge portion 34*b* is formed at a portion of the inner wall, which is adjacent to the second through hole 33*b*, of the second clamping slot 32*b*, a joint between the first clamping slot 32*a* and the first through hole 33*a* is of an arc shape, and a joint between the second clamping slot 32*b* and the second through hole 33*b* is of an arc shape, so that the first and second cutting edge portions 34*a* and 34*b* puncture insulation layers 52 (refer to FIG. 7*a*) of the first and second wires 50*a* and 50*b* more easily, and conductors 51 of the punctured first and second wires 50*a* and 50*b* may be clamped in the corresponding first and second clamping slots 32*a* and 32*b* more reliably, so that the electrical and mechanical connection that is between the first and second wires 50*a* and 50*b* and provided by the mains power wire connection assembly 100 according to the present invention is more reliable.

Moreover, the connection terminals 30 mentioned above are provided in pairs, where one connection terminal 30 is superimposed with the other connection terminal 30, which are respectively referred to as an outer connection terminal 30 and an inner connection terminal 30; a distance between first and second clamping slots 32*a* and 32*b* of the outer connection terminal 30 is different from a distance between first and second clamping slots 32*a* and 32*b* of the inner connection terminal 30. In this embodiment, the distance between the first and second clamping slots 32*a* and 32*b* of the outer connection terminal 30 is greater than the distance between the first and second clamping slots 32*a* and 32*b* of the inner connection terminal 30, so that a first wire 50*a* or second wire 50*b* having a large wire diameter is punctured and clamped at the outer connection terminal 30, and a first wire 50*a* or second wire 50*b* having a small wire diameter is punctured and clamped at the inner connection terminal 30, so that the mains power wire connection assembly 100 according to the present invention is capable of electrically connecting first wire 50*a* and second wire 50*b* having different wire diameters, thereby expanding a service range of the mains power wire connection assembly 100 according to the present invention.

Furthermore, the connection terminals 30 mentioned above are provided symmetrically about a center of the insulation body 10, so that mains power wire connection assembly 100 according to the present invention is capable of electrically connecting a first wire 50*a* and a second wire 50*b* having two different polarities (that is, a positive pole and a negative pole), thereby further expanding the service range of the mains power wire connection assembly 100 according to the present invention.

Figure 5:
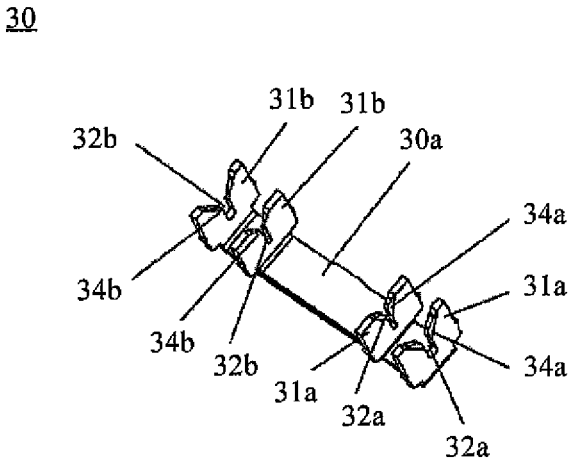
FIG. 5 is a schematic structural diagram of another embodiment of a connection terminal in a connector of a first embodiment of a mains power wire connection assembly according to the present invention.

Referring to FIG. 5, FIG. 5 shows a schematic structural diagram of another embodiment of a connection terminal of a connector in a mains power wire connection assembly according to the present invention. In FIG. 5, a difference between a structure of the connection terminal 30' and a structure of the connection terminal 30 mentioned above merely lies in that: the connection terminal 30' is not provided with the first through hole 33*a* and second through hole 33*b* mentioned above compared with the connection terminal 30. That is, the connection terminal 30' is not provided with the first through hole 33*a* mentioned above at the first puncturing clamping end 31*a*, and the connection terminal 30' is not provided with the second through hole 33*b* mentioned above at the second puncturing clamping end 31*b*, so that material of the connection terminal 30' may be reduced. Except the difference mentioned above, the structure of the connection terminal 30' is the same as the structure of the connection terminal 30, which is not described repeatedly in this embodiment.

Figure 6A:
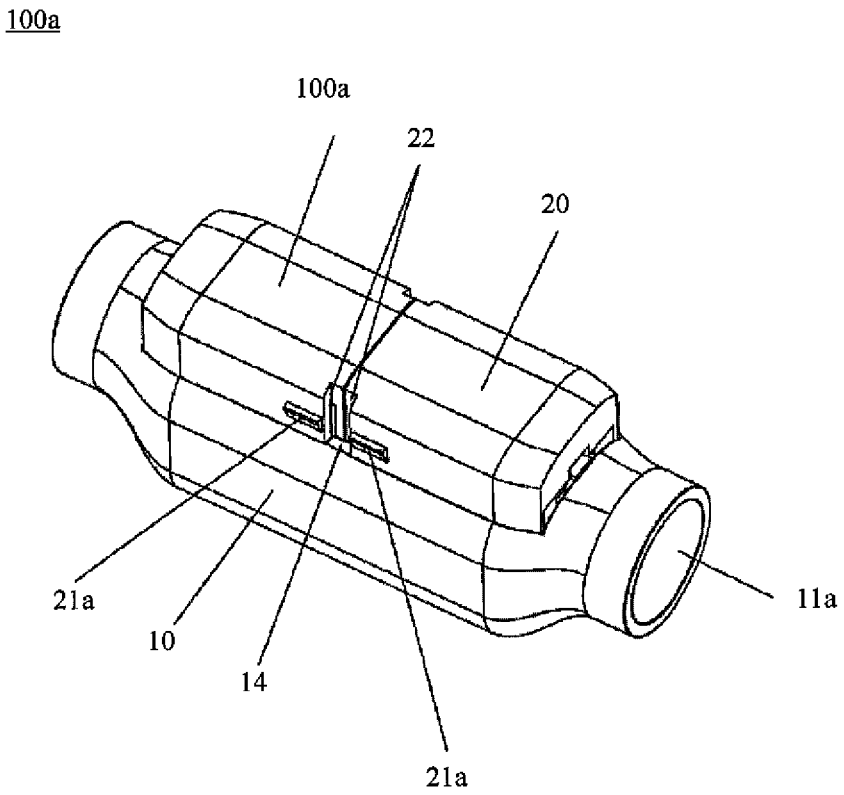
FIG. 6*a* to FIG. 6*d* are diagrams illustrating an operation process of a mains power wire connection method according to the present invention.
Figure 6B:
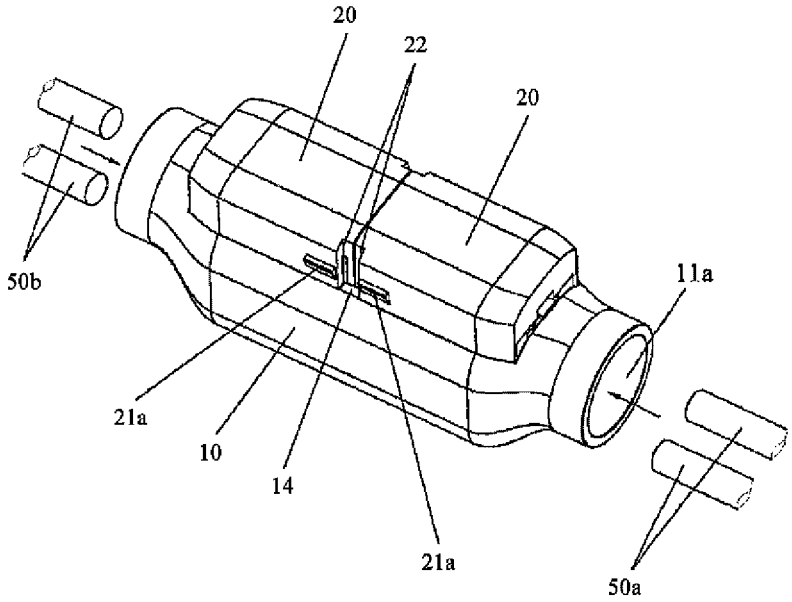

Steps included in a mains power wire connection method according to the present invention is described in detail with reference to FIG. 6*a* to FIG. 6*d* as follows:

(1) providing the connector 100*a* mentioned above, where a structure of the connector 100*a* is described in detail above and is not described repeatedly in this embodiment;

(2) providing the first wire 50*a* mentioned above and configured to transfer mains power, and inserting the first wire 50*a* into the first cable passage 11*a* and first puncturing clamping end 31*a* mentioned above along a direction indicated by an arrow besides the first wire 50*a* in FIG. 6*b;*

Figure 6C:
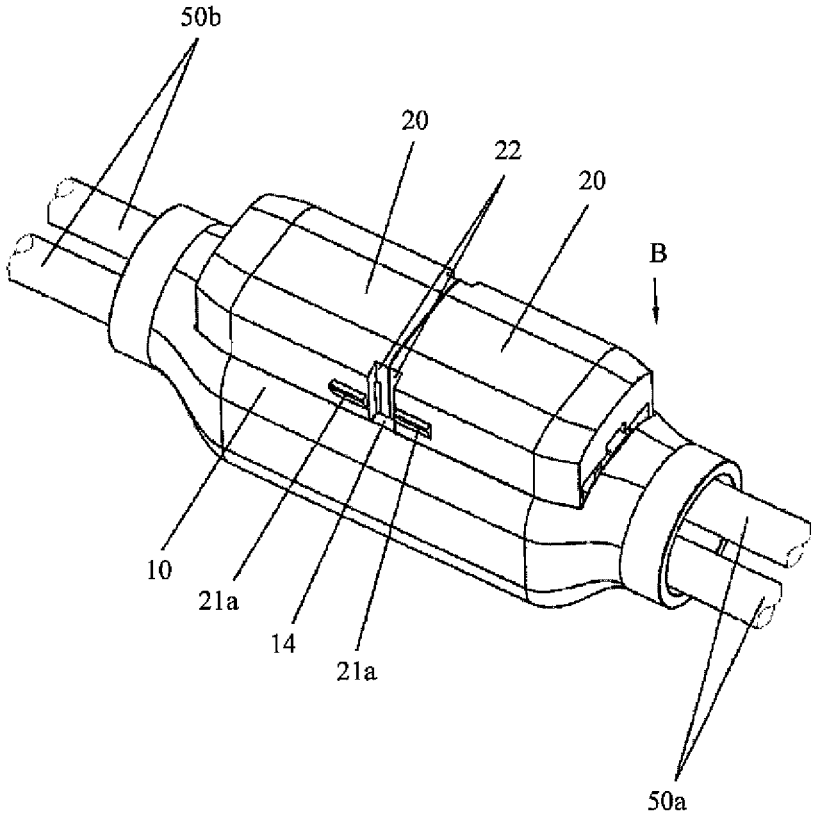
Figure 6D:
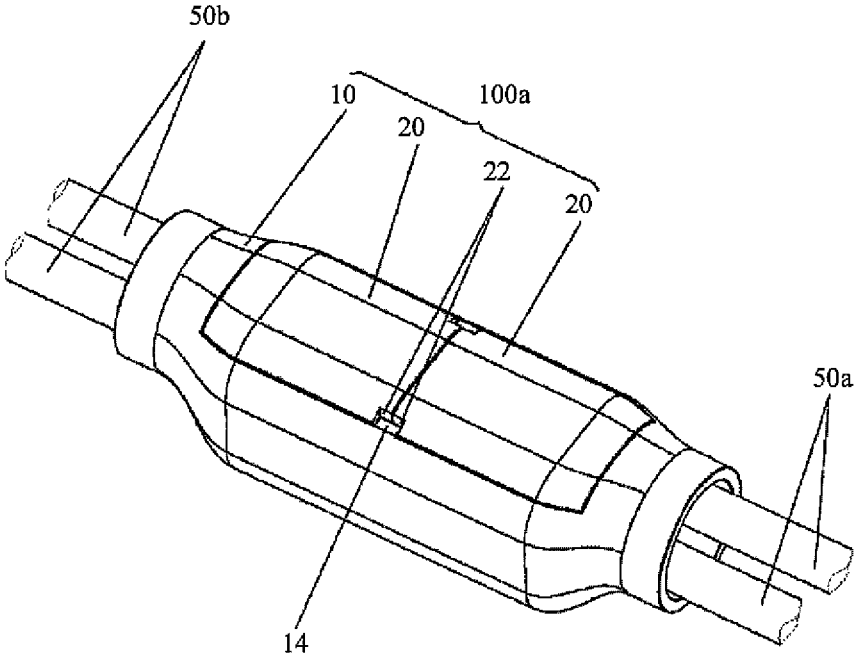
Figure 7A:
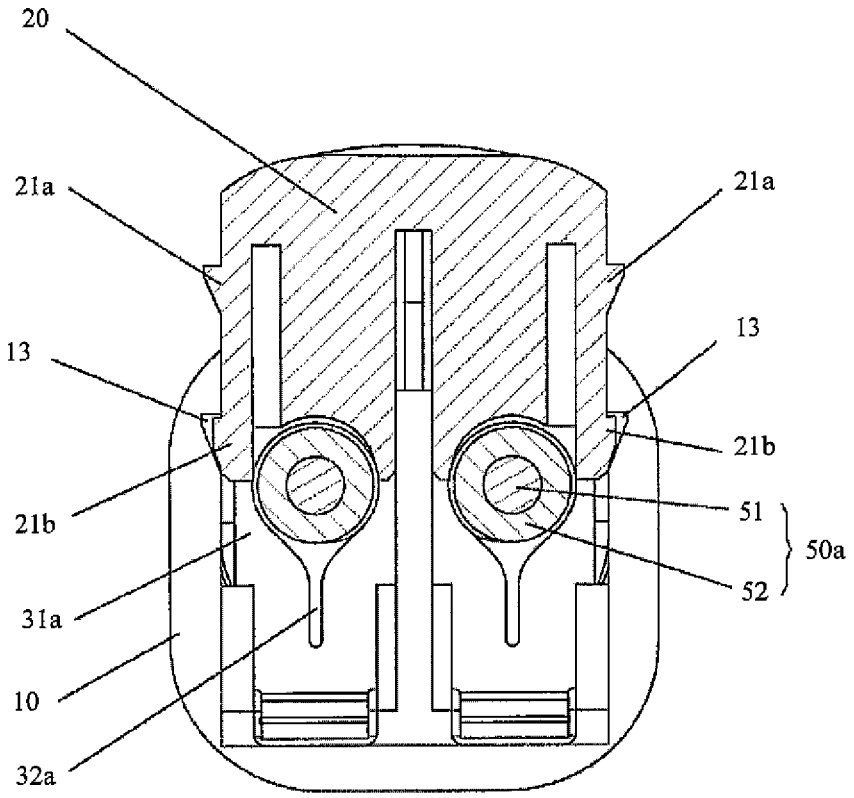
FIG. 7*a* is a cutaway drawing of FIG. 6*c* along a direction perpendicular to an insertion direction of a first wire and across the first wire and a matching place between a locking block and a locking slot.
Figure 7B:
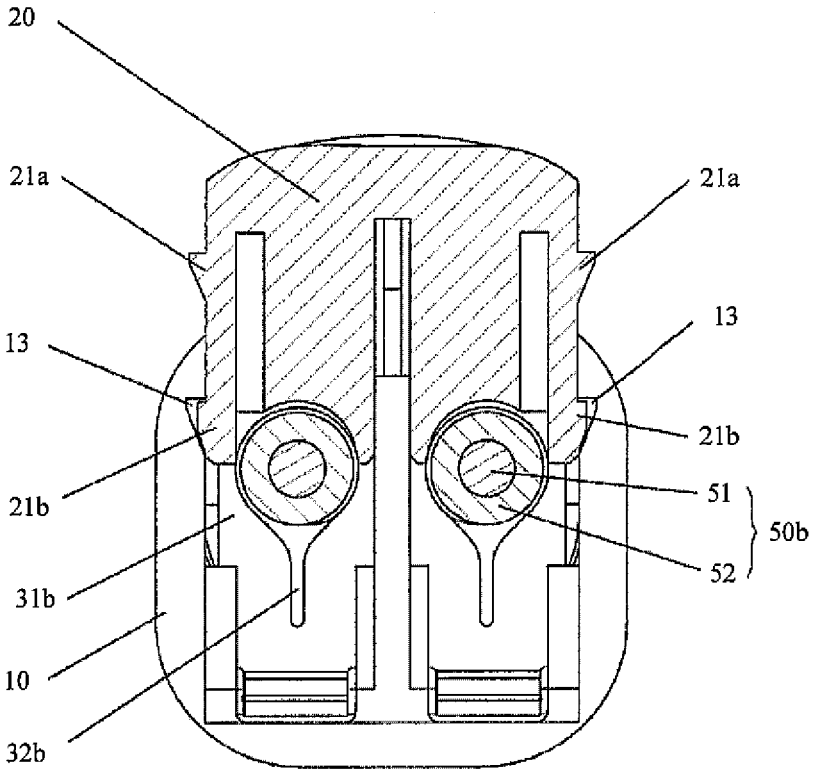
FIG. 7*b* is a cutaway drawing of FIG. 6*c* along a direction perpendicular to an insertion direction of a second wire and across the second wire and a matching place between a locking block and a locking slot.
Figure 8A:
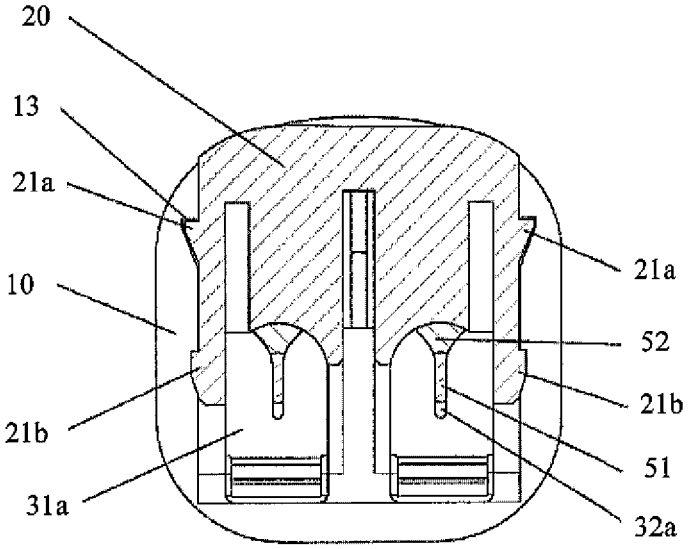
FIG. 8*a* is a cutaway drawing of FIG. 6*d* along a direction perpendicular to an insertion direction of a first wire and across the first wire and a matching place between a locking block and a locking slot.
Figure 8B:
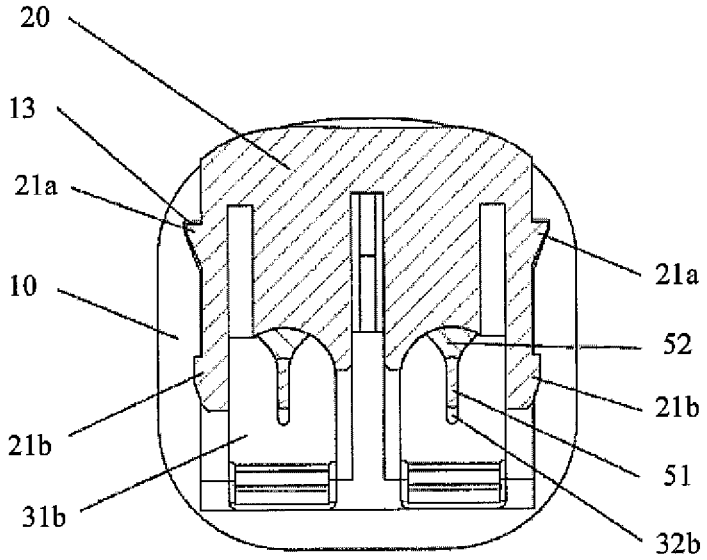
FIG. 8*b* is a cutaway drawing of FIG. 6*d* along a direction perpendicular to an insertion direction of a second wire and across the second wire and a matching place between a locking block and a locking slot.

(3) providing the second wire 50*b* mentioned above and configured to transfer mains power, and inserting the second wire 50*b* into the second cable passage 11*b* and second puncturing clamping end 31*b* mentioned above along a direction indicated by an arrow besides the second wire 50*b* in FIG. 6*b*; a state after the first and second wires 50*a* and 50*b* are inserted is shown in FIG. 6*c*, where a position relationship between the first wire 50*a* and the first clamping slot 32*a* is shown in FIG. 7*a*, and a position relationship between the second wire 50*b* and the second clamping slot 32*b* is shown in FIG. 7*b*; and (4) pressing the button 20 mention above along a direction indicated by the arrow B in FIG. 6*c* until the button 20 and the insulation body 10 mentioned above are in a locked and fixed state shown in FIG. 6*d*; in the pressing process, the push portion 20*a* of the button 20 presses the first and second wires 50*a* and 50*b* to move respectively toward the first and second clamping slots 32*a* and 32*b*, and inner walls of the first and second clamping slots 32*a* and 32*b* respectively puncture and clamp the moving first and second wires 50*a* and 50*b*, where the position relationship between the first wire 50*a* and the first clamping slot 32*a* is shown in FIG. 8*a*, and the position relationship between the second wire 50*b* and the second clamping slot 32*b* is shown in FIG. 8*b*.

Figure 9:
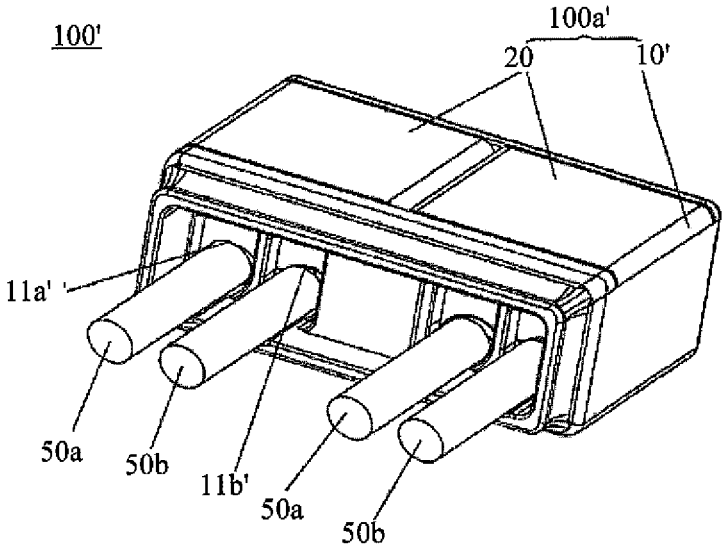
FIG. 9 is a schematic structural diagram of a second embodiment of a mains power wire connection assembly according to the present invention.
Figure 10:
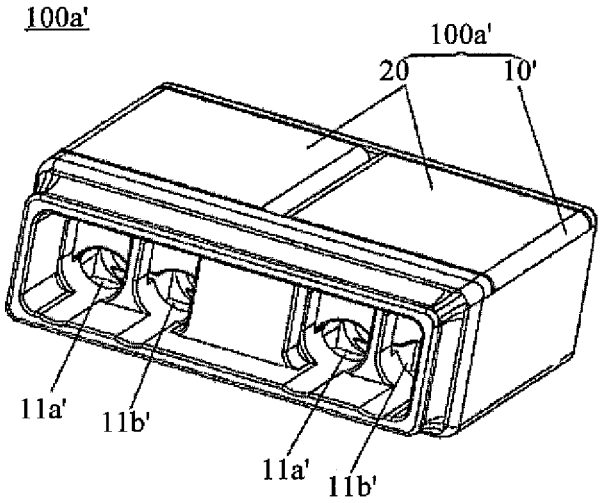
FIG. 10 is a schematic structural diagram of a connector in a second embodiment of a mains power wire connection assembly according to the present invention.
Figure 11:
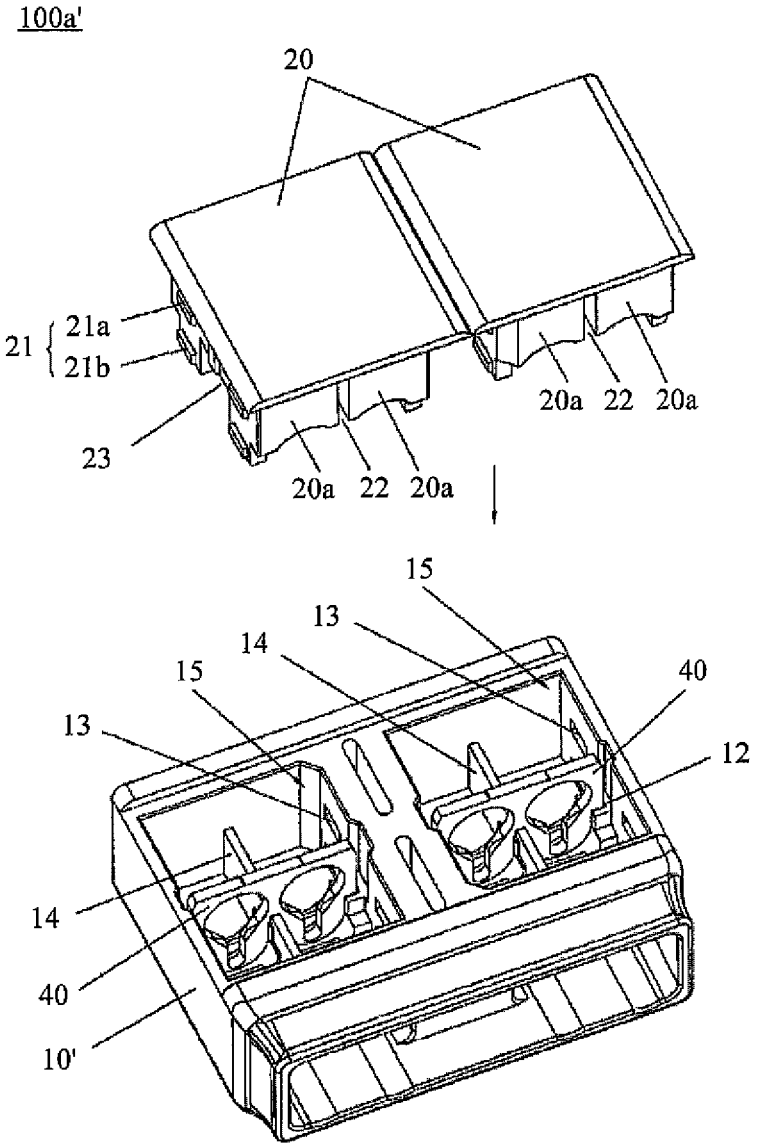
FIG. 11 is an exploded view of a connector shown in FIG. 10.
Figure 12:
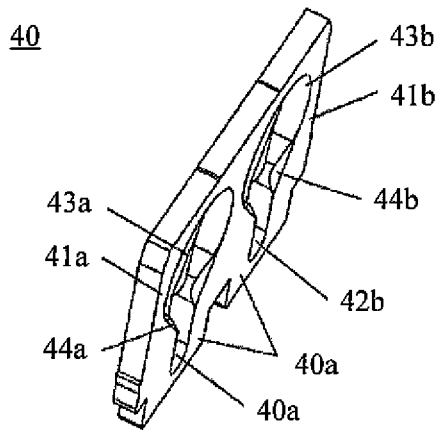
FIG. 12 is a schematic structural diagram of a connection terminal of a connector in a second embodiment of a mains power wire connection assembly according to the present invention.

Referring to FIG. 9, FIG. 9 shows a second embodiment of a mains power wire connection assembly 100' according to the present invention. A structure of the mains power wire connection assembly 100' according to this embodiment is basically the same as that of the mains power wire connection assembly 100 according to the first embodiment, where a difference therebetween lies in an insulation body and a connection terminal in a connector. The following describes differences between the mains power wire connection assembly 100' according to this embodiment and the mains power wire connection assembly 100 according to the first embodiment with reference to FIG. 10 to FIG. 12.

First, in this embodiment, an insulation body 10' of a connector 100*a*' is provided with a first cable passage 11*a*' and a second cable passage 11*b*' on the same side thereof; butin the first embodiment, the insulation body 10 of the connector 100*a* is provided with the first cable passage 11*a* at the right end thereof, and the insulation body 10 of the connector 100*a* is provided with the second cable passage 11*b* at the left end thereof, that is, the insulation body 10 is provided with the cable passages separately at two ends thereof.

Second, in this embodiment, it only needs that a containing cavity 15 of the insulation body 10' in the connector 100*a*' is in communication with the first cable passage 11*a*' and the second cable passage 11*b*; but in the first embodiment, the containing cavity 15 of the insulation body 10 in the connector 100*a* is located between the first cable passage 11*a* and the second cable passage 11*b*.

Third, in this embodiment, a connection terminal 40 of the connector 100*a*' has a base 40*a*, a first puncturing clamping end 41*a*, and a second puncturing clamping end 41*b*. Specifically, in this embodiment, the first puncturing clamping end 41*a* extends from the base 40*a* to correspond to the first cable passage 11*a*', and the second puncturing clamping end 41*b* extends from the base 40*a* to correspond to the second cable passage 11*b*', so that the first puncturing clamping end 41*a*, the base 40*a*, and the second puncturing clamping end 41*b* form a plane structure together. Furthermore, the base 40*a* is mounted at the bottom end of the insulation body 10', the first puncturing clamping end 41*a* is provided with a first clamping slot 42*a* corresponding to the first cable passage 11*a*' and extending toward the base 40*a*, and the second puncturing clamping end 41*b* is provided with a second clamping slot 42*b* corresponding to the second cable passage 11*b*' and extending toward the base 40*a*. More specifically, in this embodiment, the first puncturing clamping end 41*a* is further provided with a first through hole 43*a* corresponding to the first cable passage 11*a*', where the first through hole 43*a* is located above the first clamping slot 42*a* and is in communication with the first clamping slot 42*a*, and the first through hole 43*a* leads the first wire 50*a* into the first puncturing clamping end 41*a*; the second puncturing clamping end 41*b* is further provided with a second through hole 43*b* corresponding to the second cable passage 11*b*', where the second through hole 43*b* is located above the second clamping slot 42*b* and is in communication with the second clamping slot 42*b*, and the second through hole 43*b* leads the second wire 50*b* into the second puncturing clamping end 41*b*. Furthermore, a sharp first cutting edge portion 44*a* is formed at a portion of an inner wall, which is adjacent to the first through hole 43*a*, of the first clamping slot 42*a*, and a joint between the first clamping slot 42*a* and the first through hole 43*a* is of an arc shape; and a sharp second cutting edge portion 44*b* is formed at a portion of an inner wall, which is adjacent to the second through hole 43*b*, of the second clamping slot 42*b*, and a joint between the second clamping slot 42*b* and the second through hole 43*b* is of an arc shape. However, in the first embodiment, the connection terminal 30 has the base 30*a*; the right end of the base 30*a* bends and extends to form the first puncturing clamping end 31*a* corresponding to the first cable passage 11*a*, and the left end of the base 30*a* bends and extends to form the second puncturing clamping end 31*b* corresponding to the second cable passage 11*b*; and the first puncturing clamping end 31*a* is provided with the first clamping slot 32*a* corresponding to the first cable passage 11*a* and extending toward the base 30*a*, and the second puncturing clamping end 31*b* is provided with the second clamping slot 32*b* corresponding to the second cable passage 11*b* and extending toward the base 30*a*. Therefore, an extending and arrangement manner of the first puncturing clamping end 41*a* and the second puncturing clamping end 41*b* of the connection terminal 40 according to the second embodiment is different from an extending and arrangement manner of the first puncturing clamping end 31*a* and the second puncturing clamping end 31*b* of the connection terminal 30 according to the first embodiment.

Therefore, other structures of the mains power wire connection assembly 100' according to the second embodiment and the mains power wire connection assembly 100 according to the first embodiment are same except the first to third differences described above. That is, except the first to third differences described above, the insulation body 10' and the button 20 of the mains power wire connection assembly 100' according to the second embodiment have the same design and arrangement as those in the first embodiment, in which the insulation body 10 of the mains power wire connection assembly 100 according to the first embodiment has the containing cavity 15, the receiving and locating slot 12, the slide guide 14, and the locking slot 13, and the button 20 of the mains power wire connection assembly 100 according to the first embodiment has the slide slot 22, the push portion 20*a*, the matching slot 23, and the structure of the locking block 21 consisting of the first locking block 21*a* and the second locking block 21*b*. Therefore, the structure that is common in the second embodiment and the first embodiment is not described repeatedly in the second embodiment. Moreover, because the connection terminal 40 of the mains power wire connection assembly 100' according to the second embodiment has the same puncturing structure as the connection terminal 30 of the mains power wire connection assembly 100 according to the first embodiment, the mains power wires are punctured and clamped by the mains power wire connection assembly 100' according to the second embodiment in the same manner as that of the mains power wire connection assembly 100 according to the first embodiment, and a puncturing principle of the mains power wire connection assembly 100' according to the second embodiment is not described in detail here.

In addition, the structure of the connector 100*a*' according to the present invention has been described in the mains power wire connection assembly 100' according to the second embodiment, and therefore is not described repeatedly here.

Figure 13:
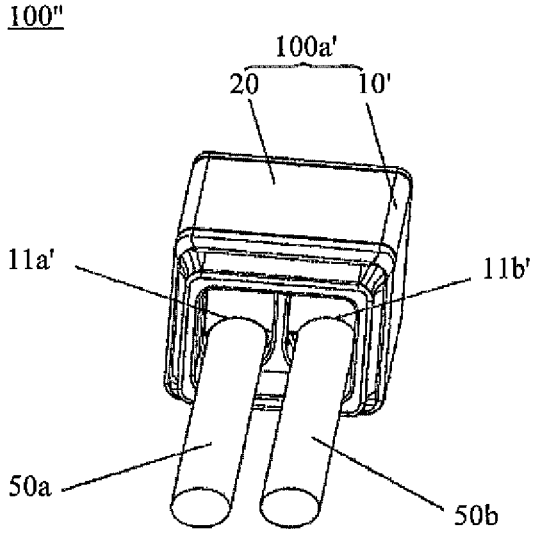
FIG. 13 is a schematic structural diagram of a third embodiment of a mains power wire connection assembly according to the present invention.

Referring to FIG. 13, FIG. 13 shows a third embodiment of a mains power wire connection assembly according to the present invention. A structure of the mains power wire connection assembly 100" according to this embodiment is basically the same as the structure of the mains power wire connection assembly 100' according to the second embodiment, where a difference merely lies in the number of connectors 100*a*'. In the third embodiment, there is one connector 100*a*; in the second embodiment, there are two connectors 100*a*', where insulation bodies 10' in the two connectors 100*a*' are of an integrated structure. Certainly, the selection of the number of connectors 100*a*' is well known to a person of ordinary skills in the art; therefore, the number of the connectors 100*a*' is not limited in the present invention. When the insulation bodies 10' in the two connectors 100*a*' are of the integrated structure, a connection terminal 40 in each connector 100*a*' may be arranged separately, so as to implement a short connection between every two wires, or the connection terminals 40 in the two connectors 100*a*' may also be interconnected to form an integrated structure, so as to implement a short connection between four wires.

It should be noted that, the first cable passage and the second cable passage may be provided at two ends of the insulation body or on the same side of the insulation body, and certainly, may also be provided at another positions of the insulation body. The button is slidably mounted at the top end of the insulation body, and may also be mounted at the top end of the insulation body in a rotatable manner. Furthermore, the containing cavity may be in communication with and located between the first cable passage and the second cable passage or located at another position. However, an arrangement of the containing cavity, the first cable passage, and the second cable passage at other positions, and the rotatable arrangement of the button do not adversely affect an objective of the present invention that the first clamping slot of the first puncturing clamping end punctuates the first wire, and the second clamping slot of the second puncturing clamping end punctuates the second wire, so that the mains power wire connection assembly according to this embodiment is capable of electrically connecting mains power wires without first removing insulation layers of the mains power wires.

The insulation body 10 according to the present invention is provided with the first cable passage 11*a* and the second cable passage 11*b* separately at two ends thereof; the insulation body 10 is further provided with the containing cavity 15 that is located between the first cable passage 11*a* and the second cable passage 11*b* and is in communication with the first cable passage 11*a* and the second cable passage 11*b*; the connection terminal 30 is arranged in the containing cavity 15 and has the base 30*a*; the base 30*a* is mounted at the bottom end of the insulation body 10; the right end of the base 30*a* bends and extends to form the first puncturing clamping end 31*a* corresponding to the first cable passage 11*a*; the left end of the base 30*a* bends and extends to form the second puncturing clamping end 31*b* corresponding to the second cable passage 11*b*; the first puncturing clamping end 31*a* is provided with the first clamping slot 32*a* corresponding to the first cable passage 11*a* and extending toward the base; the second puncturing clamping end 31*b* is provided with the second clamping slot 32*b* corresponding to the second cable passage 11*b* and extending toward the base 30*a*; the button 20 is slidably mounted at the top end of the insulation body 10; the button 20 has the push portion 20*a* extending into the containing cavity 15; when the first wire 50*a* is led into the first cable passage 11*a* and the first puncturing clamping end 31*a* at the right end of the connector 100*a* and the second wire 50*b* is led into the second cable passage 11*b* and the second puncturing clamping end 31*b* at the left end of the connector 100*a*, an operator presses the button 20, so as to push, by using the push portion 20*a* of the button 20, the first and second wires 50*a* and 50*b* to move toward the first and second clamping slots 32*a* and 32*b*; inner walls of the first and second clamping slots 32*a* and 32*b* punctuate and clamp the moving first and second wires 50*a* and 50*b*, so that the first and second wires 50*a* and 50*b* are clamped onto the connector 100*a* without first removing the insulation layers. This enables the mains power wire connection assembly 100 according to the present invention to electrically and mechanically connect mains power wires conveniently and quickly, so as to reduce a work load of the operator and avoid resource waste. Moreover, when the first and second wires 50*a* and 50*b* are clamped by the inner walls of the first and second clamping slots 32*a* and 32*b*, the first and second wires 50*a* and 50*b* are also under a fixing force provided by the locked and fixed the button 20 and the insulation body 10, so as to effectively prevent the first and second wires 50*a* and 50*b* that are electrically and mechanically connected from loosening, and may avoid a problem of decreased tensile performance caused when conductors of the mains power wires are conventionally connected by twisting, so that the electrical and mechanical connection that is between the mains power wires and provided by the mains power wire connection assembly 100 according to the present invention is more reliable.

The above are merely preferred embodiments of the present invention. However, the protection scope of the present invention is not limited thereto. Therefore, equivalent changes derived according to the claims of the present invention shall fall within the protection scope of the present invention.

What is claimed is:

1. A mains power wire connection assembly, comprising:

a first wire, configured to transfer mains power;

a second wire, configured to transfer mains power; and a connector, configured to connect the first wire to the second wire;

wherein the connector comprises an insulation body, a slidable button, and a conductive connection terminal;

the insulation body, configured to comprise cable passages and a containing cavity which is located between and in communication with the cable passages;

the connection terminal, configured to be arranged in the containing cavity, and configured to comprise a base and puncturing clamping ends, wherein the puncturing clamping ends are provided with clamping slots corresponding to the cable passages respectively and extending toward the base, and the puncturing clamping ends have through holes that are in communication with the clamping slots; wherein the first wire and the second wire are led to the cable passages and the clamping slots respectively;

the slidable button, configured to push the first wire and the second wire to move toward clamping slots to be punctuated and clamped, and then the first wire and the second wire being clamped in the inner walls of the clamping slots.

2. The mains power wire connection assembly according to claim 1, wherein the puncturing clamping ends are further provided with through holes corresponding to the cable passages respectively, the through holes are located above the clamping slots and are in communication with the clamping slots, and the wires are led through the through holes into the puncturing clamping ends.

3. The mains power wire connection assembly according to claim 2, wherein sharp cutting edge portions are formed at portions of the inner walls, which are adjacent to the through holes, of the clamping slots, and joints between the clamping slots and the through holes are of an arc shape.

4. The mains power wire connection assembly according to claim 1, wherein the connection terminals are provided in pairs, one connection terminal is superimposed with and located within the other connection terminal, and a distance between clamping slots of one of the two connection terminals is different from that of the other of the two connection terminals.

5. The mains power wire connection assembly according to claim 1, wherein an inner wall of the containing cavity is provided with receiving and locating slots configured to receive and fix the puncturing clamping ends of the connection terminal.

6. The mains power wire connection assembly according to claim 1, wherein the button is provided with elastic locking blocks on two sides thereof, the insulation body is correspondingly provided with locking slots matching with the locking blocks, and the locking blocks are locked in the locking slots.

7. The mains power wire connection assembly according to claim 6, wherein the locking block comprises a first locking block and a second locking block located sequentially along a pushing direction, and during a slide movement of the button slides into the insulation body, the locking slots lock the second and first locking blocks sequentially.

8. The mains power wire connection assembly according to claim 1, wherein the button is provided with slide slots on two sides thereof along a pushing direction, the insulation body is correspondingly provided with slide guides matching with the slide slots, and the button is further provided with matching slots matching with the puncturing clamping ends, wherein the puncturing clamping ends slidably extend into the matching slots.

9. A mains power wire connection assembly, comprising:

a first wire, configured to transfer mains power;

a second wire, configured to transfer mains power; and a connector, configured to connect the first wire to the second wire, wherein the connector comprises an insulation body, a movable button, and a conductive connection terminal;

the insulation body, configured to comprise a first cable passage and a second cable passage and a containing cavity which is in communication with the first and second cable passages;

the connection terminal, configured to be arranged in the containing cavity, and configured to comprise a base and a first puncturing clamping end, and a second puncturing clamping end, wherein the first puncturing clamping end is provided with a first clamping slot corresponding to the first cable passage and extending toward the base, and the second puncturing clamping end is provided with a second clamping slot corresponding to the second cable passage and extending toward the base;

the moveable button, configured to push the first wire and the second wire to move toward clamping slots to be punctuated and clamped, and then the first wire and the second wire being clamped in the inner walls of the clamping slots; and the button and the insulation body are locked and fixed with respect to each other.

10. The mains power wire connection assembly according to claim 9, wherein the first puncturing clamping end is further provided with a first through hole corresponding to the first cable passage, the first through hole is located above the first clamping slot and is in communication with the first clamping slot, and the first wire is led through the first through hole into the first puncturing clamping end; and the second puncturing clamping end is further provided with a second through hole corresponding to the second cable passage, the second through hole is located above the second clamping slot and is in communication with the second clamping slot, and the second wire is led through the second through hole into the second puncturing clamping end.

11. The mains power wire connection assembly according to claim 10, wherein a sharp first cutting edge portion is formed at a portion of the inner wall, which is adjacent to the first through hole, of the first clamping slot, and a joint between the first clamping slot and the first through hole is of an arc shape; and a sharp second cutting edge portion is formed at a portion of the inner wall, which is adjacent to the second through hole, of the second clamping slot, and a joint between the second clamping slot and the second through hole is of an arc shape.

12. The mains power wire connection assembly according to claim 9, wherein the button is provided with elastic locking blocks on two sides thereof, the insulation body is correspondingly provided with locking slots matching with the locking blocks, and the locking blocks are locked in the locking slots.

13. A connector, configured to connect a first wire and a second wire that are configured to transfer mains power, wherein the connector comprises an insulation body, a button, and a conductive connection terminal;

the insulation body is provided with a first cable passage and a second cable passage on one side thereof; the insulation body is further provided with a containing cavity which is in communication with the first and second cable passages;

the connection terminal is arranged in the containing cavity and has a base, a first puncturing clamping end, and a second puncturing clamping end; the base is mounted at the bottom end of the insulation body; the first puncturing clamping end is provided with a first clamping slot corresponding to the first cable passage and extending toward the base, and the second puncturing clamping end is provided with a second clamping slot corresponding to the second cable passage and extending toward the base; the button is movably mounted at the top end of the insulation body and has a push portion extending into the containing cavity; the first wire is led into the first cable passage and the first puncturing clamping end, and the second wire is led into the second cable passage and the second puncturing clamping end; the first and second wires are pushed by the push portion of the button to move toward the first and second clamping slots, and are punctured and clamped by inner walls of the first and second clamping slots during movement; and the button and the insulation body are locked and fixed with respect to each other.

14. The connector according to claim 13, wherein the first puncturing clamping end is further provided with a first through hole corresponding to the first cable passage, the first through hole is located above the first clamping slot and is in communication with the first clamping slot, and the first wire is led through the first through hole into the first puncturing clamping end; and the second puncturing clamping end is further provided with a second through hole corresponding to the second cable passage, the second through hole is located above the second clamping slot and is in communication with the second clamping slot, and the second wire is led through the second through hole into the second puncturing clamping end.

15. The connector according to claim 14, wherein a sharp first cutting edge portion is formed at a portion of the inner wall, which is adjacent to the first through hole, of the first clamping slot, and a joint between the first clamping slot and the first through hole is of an arc shape; and a sharp second cutting edge portion is formed at a portion of the inner wall, which is adjacent to the second through hole, of the second clamping slot, and a joint between the second clamping slot and the second through hole is of an arc shape.

16. The connector according to claim 13, wherein the button is provided with elastic locking blocks on two sides thereof, the insulation body is correspondingly provided with locking slots matching with the locking blocks, and the locking blocks are locked in the locking slots.

* * * * *